US011149549B2

(12) United States Patent
Koda

(10) Patent No.: US 11,149,549 B2
(45) Date of Patent: Oct. 19, 2021

(54) BLADE OF STEAM TURBINE AND STEAM TURBINE

(71) Applicant: MITSUBISHI HEAVY INDUSTRIES COMPRESSOR CORPORATION, Tokyo (JP)

(72) Inventor: Takuro Koda, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 609 days.

(21) Appl. No.: 16/076,150

(22) PCT Filed: Aug. 9, 2016

(86) PCT No.: PCT/JP2016/073385
§ 371 (c)(1),
(2) Date: Aug. 7, 2018

(87) PCT Pub. No.: WO2018/029770
PCT Pub. Date: Feb. 15, 2018

(65) Prior Publication Data

US 2021/0189883 A1 Jun. 24, 2021

(51) Int. Cl.
*F01D 5/14* (2006.01)
*F01D 9/02* (2006.01)

(52) U.S. Cl.
CPC ..... *F01D 5/141* (2013.01); *F01D 9/02* (2013.01); *F05D 2240/301* (2013.01); *F05D 2250/70* (2013.01)

(58) Field of Classification Search
CPC . F01D 5/14; F01D 5/141; F01D 5/145; F01D 5/147; F01D 5/148; F01D 9/02; F04D 20/684
See application file for complete search history.

(56) References Cited

U.S. PATENT DOCUMENTS 5,876,182 A 3/1999 Schulte
8,727,725 B1 5/2014 Liang
(Continued)

FOREIGN PATENT DOCUMENTS

JP S58-013105 A 1/1983
JP S63-230904 A 9/1988
(Continued)

OTHER PUBLICATIONS

International Search Report issued in corresponding International Application No. PCT/JP2016/073385 dated Oct. 25, 2016 (4 pages).
(Continued)

*Primary Examiner* — J. Todd Newton
*Assistant Examiner* — Cameron A Corday
(74) *Attorney, Agent, or Firm* — Osha Bergman Watanabe & Burton LLP

(57) ABSTRACT

A blade of a steam turbine includes a plurality of turbine blade rows which are fixed to a radially outer side of a rotor shaft rotating about an axis, and are arranged in an axial direction in which the axis extends, and a turbine vane row which is disposed to be adjacent to an upstream side of the turbine blade row in the axial direction for each of the plurality of turbine blade rows, the blade of a steam turbine including a blade body which is disposed in a steam main flow path which is formed around a rotary shaft such that main steam flows through the steam main flow path, the blade body having an airfoil cross section in which a concave positive-pressure surface and a convex negative-pressure surface are continuous to each other via a leading edge and a trailing edge.

5 Claims, 5 Drawing Sheets

(56) References Cited

U.S. PATENT DOCUMENTS

| | | | | |
|---|---|---|---|---|
| 8,834,116 | B2 * | 9/2014 | Guemmer | F04D 29/681 416/93 R |
| 2005/0141990 | A1 | 6/2005 | Guemmer | |
| 2013/0064638 | A1 * | 3/2013 | Subramaniyan | F01D 11/04 415/1 |

FOREIGN PATENT DOCUMENTS

| | | | |
|---|---|---|---|
| JP | H09-125908 | A | 5/1997 |
| JP | H09-195705 | A | 7/1997 |
| JP | 2001-065302 | A | 3/2001 |

OTHER PUBLICATIONS

Written Opinion issued in corresponding International Application No. PCT/JP2016/073385 dated Oct. 25, 2016 (7 pages).

* cited by examiner

BLADE OF STEAM TURBINE AND STEAM TURBINE

TECHNICAL FIELD

The present invention relates to a blade of a steam turbine and a steam turbine.

BACKGROUND ART

A steam turbine includes a rotor which is rotated about an axis and a casing which covers the rotor. The rotor includes a rotor shaft which extends in an axial direction about the axis and a plurality of stages of turbine blade rows which are fixed to an outer periphery of the rotor shaft and are arranged in the axial direction. The steam turbine includes a turbine vane row which is fixed to an inner periphery of the casing and is disposed on an upstream side of each stage of the plurality of stages of turbine blade rows. Each of the turbine blade rows includes a plurality of turbine blades which are disposed around the rotor. The turbine vane row includes a plurality of turbine vanes which are disposed around the rotor on an upstream side of the turbine blade.

The turbine blade or the turbine vane includes a positive-pressure surface which receives a pressure from a fluid and a negative-pressure surface which has a negative pressure relative to the pressure acting on the positive-pressure surface. In the steam turbine, by increasing a pressure of main steam flowing along the positive-pressure surface and lowering the pressure of the main steam flowing along the negative-pressure surface to a negative pressure relative to the pressure of the main steam on the positive-pressure surface, a drive force is generated.

In the turbine blade or the turbine vane, the main steam flowing along the negative-pressure surface is separated and the flow is disturbed, and thus, blade performance decreases. Accordingly, for example, PTL 1 discloses a blade structure which suppresses a wake from the vicinity of a trailing edge generated by a separation of a flow on a negative-pressure surface. Specifically, a blade structure is disclosed in which an extraction slit is formed on a ventral surface, which is a positive-pressure surface, to draw in wakes generated in adjacent other blades on an upstream side.

CITATION LIST

Patent Literature

[PTL 1] Japanese Unexamined Patent Application, First Publication No. 2001-065302

SUMMARY OF INVENTION

Technical Problem

However, in a steam turbine, it is desirable not only to use the above-described structure but also to further improve efficiency by suppressing a decrease in blade performance due to separation on the negative-pressure surface.

The present invention provides a blade of a steam turbine and the steam turbine capable of effectively suppressing separation on the negative-pressure surface.

Solution to Problem

According to a first aspect of the present invention, a blade of a steam turbine is provided, including: a blade body which is disposed in a steam main flow path which is formed around a rotary shaft rotating about an axis such that main steam flows through the steam main flow path, the blade body having an airfoil cross section in which a concave positive-pressure surface and a convex negative-pressure surface are continuous to each other via a leading edge and a trailing edge, in which the blade body includes a first flow path which is formed inside the blade body to extend in a blade height direction intersecting the airfoil cross section and through which steam having a pressure higher than that of the main steam to which the positive-pressure surface and the negative-pressure surface are exposed flows, and a second flow path through which the steam flowing through the first flow path is ejected from the negative-pressure surface opening hole formed on the negative-pressure surface.

According to this configuration, the steam ejected from the negative-pressure surface opening hole can be joined to the flow of the main steam flowing along the negative-pressure surface. As a result, the development of a boundary layer around the negative-pressure surface can be suppressed.

In the steam turbine according to a second aspect of the present invention, in the first aspect, the negative-pressure surface opening hole may be formed on a side closer to the trailing edge than a center position in a blade surface direction which is including a component in a blade chord direction of the blade body and which is a direction along the negative-pressure surface in the airfoil cross section.

According to this configuration, it is possible to intensively supply the steam to the trailing edge side. Accordingly, it is possible to suppress the separation effectively using the steam on the trailing edge side of the negative-pressure surface at which the separation is easily generated.

In the blade of the steam turbine according to a third aspect of the present invention, in the first or second aspect, the negative-pressure surface opening hole may be formed on a radially inner side from a center position of the blade body in a radial direction of the rotor shaft.

According to this configuration, it is possible to intensively supply the steam to the radially inner side. Accordingly, it is possible to suppress the separation effectively using the steam on the radially inner side of the negative-pressure surface at which the separation is easily generated.

In the blade of the steam turbine according to a fourth aspect of the present invention, in any one of the first to third aspects, the blade of the steam turbine may further include a third flow path which extends from the first flow path toward the trailing edge side and through which the steam flowing through the first flow path is ejected from a positive-pressure surface opening hole formed on the positive-pressure surface.

According to this configuration, the steam is ejected from the positive-pressure surface opening hole, and thus, the steam ejected from the positive-pressure surface opening hole can be joined to the flow of the main steam along the negative-pressure surfaces of other blade of the steam turbines adjacent in the circumferential direction. As a result, it is possible to further suppress the development of the boundary layer in the vicinity of the negative-pressure surface by a lot of steam.

In the blade of the steam turbine according to a fifth aspect of the present invention, in the fourth aspect, the positive-pressure surface opening hole may be formed on a side closer to the trailing edge than a center position in a blade surface direction which is including a component in a blade chord direction of the blade body and which is a direction along the negative-pressure surface in the airfoil cross section.

According to this configuration, the steam can be intensively supplied not only from the negative-pressure surface opening hole but also from the positive-pressure surface opening hole to the trailing edge sides of the blade of the steam turbines adjacent to each other. Accordingly, it is possible to further suppress the separation effectively using the steam on the trailing edge side of the negative-pressure surface at which the separation is easily generated.

In the blade of the steam turbine according to a sixth aspect of the present invention, in the fourth or fifth aspect, the positive-pressure surface opening hole may be formed on a radially inner side from a center position of the blade body in a radial direction of the rotor shaft.

According to this configuration, it is possible to intensively supply the steam not only from the negative-pressure surface opening hole but also from the positive-pressure surface opening hole to the radially inner side in the negative-pressure surface of the adjacent blade of the steam turbine. Therefore, it is possible to further suppress the separation effectively using the steam on the radially inner side of the negative-pressure surface at which the separation is easily generated.

In the blade of the steam turbine according to a seventh aspect of the present invention, in any one of the first to sixth aspects, the blade of the steam turbine may be provided in a steam turbine including a plurality of turbine blade rows which are fixed to a radially outer side of the rotor shaft and are arranged in an axial direction in which the axis extends and a turbine vane row which is disposed to be adjacent to an upstream side of the turbine blade row in the axial direction for each of the plurality of turbine blade rows, and the blade body is provided in at least one of a turbine blade and a turbine vane of a final stage which is disposed on the most downstream side in a plurality of stages configured of a combination of the turbine blade rows and the turbine vane rows disposed to be adjacent to the upstream sides of the turbine blade rows.

According to this configuration, it is possible to suppress the occurrence of a backflow of the main steam from an outlet side of the steam turbine.

According to an eighth aspect of the present invention, a steam turbine is provided, including: a rotor shaft which is rotated about an axis; and a plurality of blades of the steam turbines according to any one of the first to sixth aspects disposed in a circumferential direction of the rotor shaft.

According to this configuration, it is possible to improve blade efficiency or decrease a loss generated by the backflow of the steam, and it is possible to improve operation efficiency.

Advantageous Effects of Invention

According to the present invention, it is possible to effectively suppress the separation on the negative-pressure surface.

DESCRIPTION OF EMBODIMENTS

First Embodiment

Hereinafter, a steam turbine 1 according to the present invention will be described with reference to the drawings.

Figure 1:
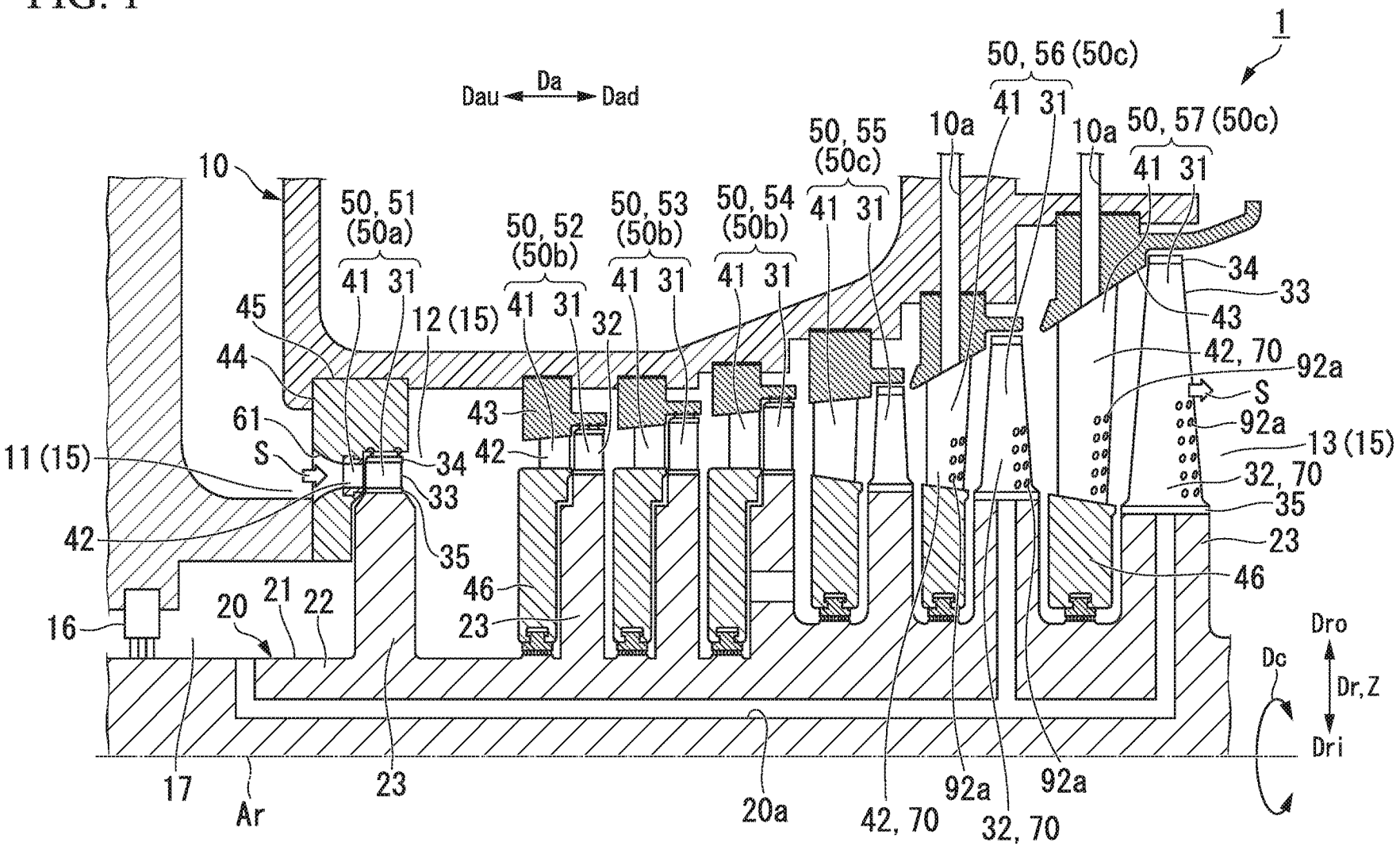
FIG. 1 is a sectional view of a steam turbine in a first embodiment of the present invention.

As shown in FIG. 1, the steam turbine 1 of the present embodiment includes a rotor 20 which is rotated about an axis Ar and a casing 10 which rotatably covers the rotor 20.

Moreover, for convenience of the following description, a direction in which the axis Ar extends is referred to as an axial direction Da. A first side (one side) in the axial direction Da is referred to as an upstream side Dau and a second side (the other side) in the axial direction Da is referred to as a downstream side Dad. In addition, a radial direction in the rotor 20 based on the axis Ar is simply referred to as a radial direction Dr. A side close to the axis Ar in the radial direction Dr is referred to as a radially inner side Dri, and a side opposite to the radially inner side Dri in the radial direction Dr is referred to as a radially outer side Dro. In addition, a circumferential direction of the rotor 20 about the axis Ar is simply referred to as a circumferential direction Dc.

The rotor 20 includes a rotor shaft 21 and a plurality of turbine blade rows 31 which are provided in the rotor shaft 21 at intervals in the axial direction Da.

The rotor shaft 21 is rotated about the axis Ar. The rotor shaft 21 includes an axial core portion 22 and a plurality of disk portions 23. The axial core portion 22 is formed in a columnar shape about the axis Ar and extends in the axial direction Da. Each of the disk portions 23 spreads from the axial core portion 22 toward the radially outer side Dro. The disk portions 23 are arranged at intervals in the axial direction Da. The disk portion 23 is provided for each of the plurality of turbine blade rows 31.

The turbine blade row 31 is attached to an outer periphery of the disk portion 23, which is an outer peripheral portion of the rotor shaft 21. The plurality of turbine blade rows 31 are provided in the rotor shaft 21 at intervals in the axial direction Da. In the case of the present embodiment, the number of the turbine blade rows 31 is seven. Accordingly, in the case of the present embodiment, in the turbine blade rows 31, the turbine blade rows 31 from a first stage 51 to a seventh stage 57 which is the final stage (to be described later), are provided. Each of the turbine blade rows 31 includes a plurality of turbine blades 32 which are arranged in the circumferential direction Dc.

The steam turbine 1 includes a plurality of turbine vane rows 41 which are fixed to an inner periphery of the casing 10. The plurality of turbine vane rows 41 are provided at intervals in the axial direction Da. In the case of the present embodiment, the number of the turbine vane rows 41 is seven, which is the same as the number of the turbine blade rows 31. Accordingly, in the case of the present embodiment, in the turbine vane rows 41, the turbine vane rows 41 from the first stage 51 to the seventh stage 57 which is the final stage (to be described later), are provided. Each of the plurality of turbine vane rows 41 is disposed to be adjacent to each of the turbine blade rows 31 on the upstream side Dau.

Each of the turbine vane rows 41 includes a plurality of turbine vanes 42 which are arranged in the circumferential direction Dc, an annular outer ring 43 which is provided on the radially outer side Dro of the plurality of turbine vanes 42, and an annular inner ring 46 which is provided on the radially inner side Dri of the plurality of turbine vanes 42. That is, the plurality of turbine vanes 42 are disposed between the outer ring 43 and the inner ring 46. The turbine vanes 42 are fixed to the outer ring 43 and the inner ring 46.

One stage 50 is formed for each pair of turbine blade rows 31 and the turbine vane row 41 arranged to be adjacent to the upstream side Dau of the turbine blade row 31. In the steam turbine 1 of the present embodiment, the turbine vane row 41 is provided for each of seven turbine blade rows 31, and thus, seven stages 50 are provided. That is, the steam turbine 1 of the present embodiment includes the first stage 51, the second stage 52, the third stage 53, the fourth stage 54, the fifth stage 55, the sixth stage 56, and the seventh stage 57 in this order from the upstream side Dau to the downstream side Dad.

In the steam turbine 1 of the present embodiment, among the plurality of stages 50, the most upstream first stage 51 forms a speed-adjusting stage 50*a*. The speed-adjusting stage 50*a* adjusts a flow rate of a main steam S fed to the stages 50 on the downstream side Dad of the speed-adjusting stage 50*a* so as to adjust a rotational speed of the rotor 20.

In the steam turbine 1 of the present embodiment, the second stage 52, the third stage 53, and the fourth stage 54 form an intermediate pressure stage 50*b*. Moreover, in the steam turbine 1 of the present embodiment, the fifth stage 55, the sixth stage 56, and the seventh stage 57 form a low-pressure stage 50*c*.

In the casing 10, a nozzle chamber 11 into which the main steam S flows from the outside, a steam main flow path chamber 12 through which the main steam S from the nozzle chamber 11 flows, and an exhaust chamber 13 to which the main steam S flowing from the steam main flow path chamber 12 is discharged are provided. The turbine blade row 31 and the turbine vane row 41 of the first stage 51 on the most upstream side Dau among the plurality of turbine blade rows 31 and the plurality of turbine vane rows 41 are disposed between the nozzle chamber 11 and the steam main flow path chamber 12. That is, an inner space of the casing 10 is partitioned into the nozzle chamber 11 and the steam main flow path chamber 12 by the turbine blade row 31 and the turbine vane row 41 on the most upstream side Dau. A steam main flow path 15 through which the high-pressure main steam S flows is configured by the nozzle chamber 11, the steam main flow path chamber 12, and the exhaust chamber 13.

The high-pressure main steam flows through the steam main flow path 15 while the pressure of the high-pressure main steam gradually decreases from the upstream side Dau toward the downstream side Dad. The steam main flow path 15 is formed in an annular shape around the rotor shaft 21. The steam main flow path 15 extends in the axial direction Da so as to extend over the plurality of turbine blade rows 31 and turbine vane rows 41. A portion of the steam main flow path 15 is formed by an annular space in which the turbine vane 42 is disposed and which is a space between the outer ring 43 and the inner ring 46 of the turbine vane row 41.

A seal space 17 is formed on the radially inner side Dri of the nozzle chamber 11 between the casing 10 and the rotor 20. A plurality of sealing members such as a labyrinth seal are provided in the seal space 17. The seal space 17 is connected to the steam main flow path 15 by a gap between the turbine vane row 41 and the turbine blade row 31 of the speed-adjusting stage 50*a*. The seal member is provided on the radially inner side Dri of the nozzle chamber 11. The seal member seals a portion between the seal space 17 and the outside such that the main steam S does not flow from a portion between the axial core portion 22 and the casing 10 to the outside of the casing 10. That is, the seal space 17 is a space between the casing 10 and the rotor 20 and is sealed so as to communicate with the outside of the steam turbine 1 via the seal member.

Hereinafter, an embodiment of a blade of the steam turbine of the present invention will be described.

The blade of the steam turbine is at least one of the plurality of turbine blades 32 and the plurality of turbine vanes 42 provided in the steam turbine 1. In the present embodiment, the blade of the steam turbine includes at least one of the turbine blades 32 and the turbine vanes 42 of the final stage disposed on the most downstream side Dad of the plurality of turbine blades 32 and the plurality of turbine vanes 42. Specifically, the blade of the steam turbine of the present embodiment is the turbine blades 32 and the turbine vanes 42 of the sixth stage 56 and the turbine blades 32 and the turbine vanes 42 of the seventh stage 57 of the plurality of turbine blades 32 and the plurality of turbine vanes 42.

Here, in the first embodiment, as an example of the blade of the steam turbine, the turbine blade 32 of the seventh stage 57 of the turbine blades 32 and the turbine vanes 42 of the sixth stage 56 and the turbine blades 32 and the turbine vanes 42 of the seventh stage 57 are described.

The turbine blade 32 of the seventh stage 57 includes a blade body 70, a shroud 34, and a platform 35. The blade body 70 extends in the radial direction Dr. The shroud 34 is provided on the radially outer side Dro of the blade body 70. The platform 35 is provided on the radially inner side Dri of the blade body 70. An annular space between the shroud 34 and the platform 35 forms a portion of the steam main flow path 15 through which the main steam S flows.

Figure 2:
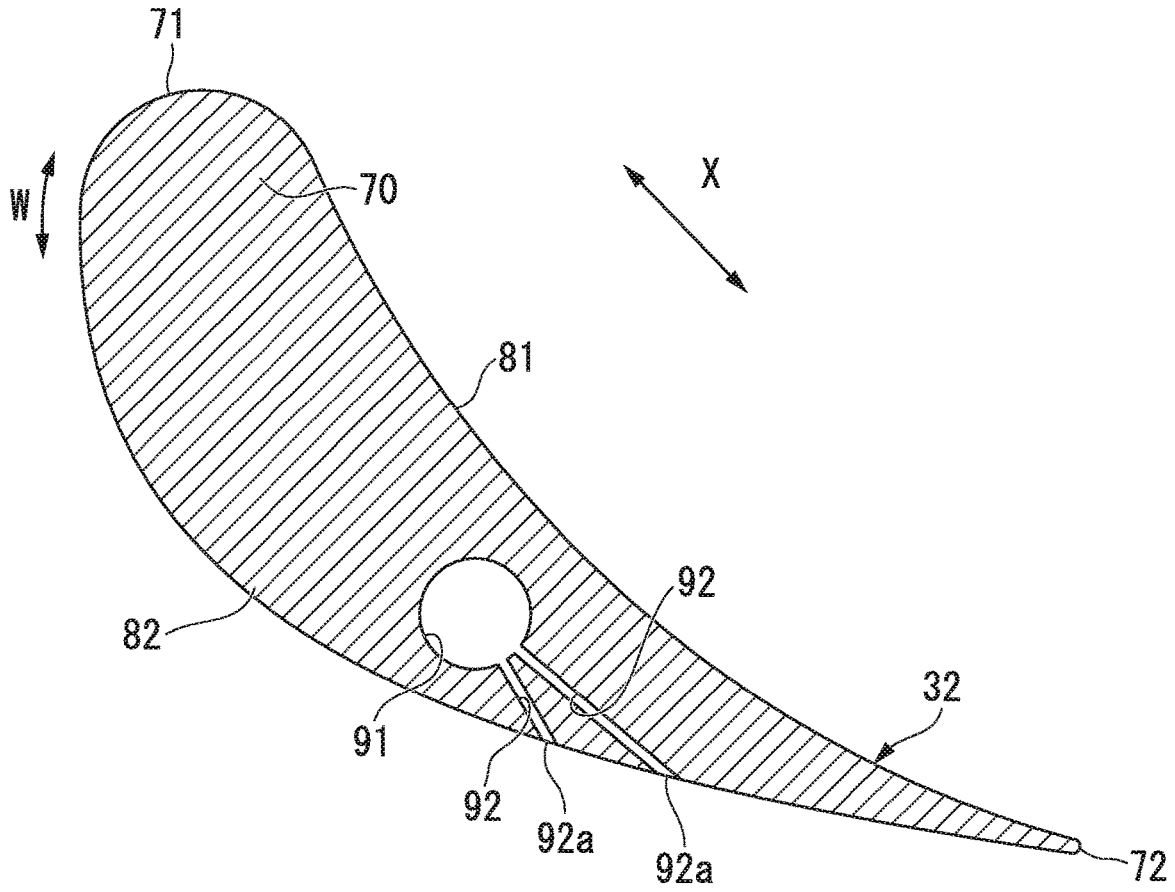
FIG. 2 is a sectional view of a turbine blade in the first embodiment of the present invention.

The blade body 70 is disposed in the steam main flow path 15. As shown in FIG. 2, the blade body 70 has an airfoil cross section in which a concave positive-pressure surface 81 and a convex negative-pressure surface 82 are continuous to each other via a leading edge 71 and a trailing edge 72. The blade body 70 extends in a blade height direction Z which intersects the airfoil cross section. The blade body 70 extends in the radial direction Dr with respect to the rotor shaft 21. A first flow path 91 and second flow paths 92 are formed inside the blade body 70.

In addition, in the present embodiment, the blade height direction Z of the blade body 70 is the direction in which the blade 70 extends and is the radial direction Dr in the present embodiment. Moreover, in the present embodiment, a blade chord direction X described later of the blade body 70 is a direction orthogonal to the blade height direction Z and is a direction in which a blade chord of the blade body 70 extends.

Moreover, a blade surface direction W of the blade body 70 is a direction along an outer surface such as the positive-pressure surface 81 or the negative-pressure surface 82, and is a direction including a component in the blade chord direction X. That is, the blade surface direction W is a direction in which the blade surface (positive-pressure surface 81 or the negative-pressure surface 82) of the blade body 70 extends in an airfoil cross section orthogonal to the blade height direction Z.

The first flow path 91 is formed to extend in the blade height direction Z inside the blade body 70. Steam having a pressure higher than that of the main steam S flowing through the steam main flow path 15 to which the positive-pressure surface 81 and the negative-pressure surface 82 are exposed flows through the first flow path 91. The first flow path 91 communicates with a rotor steam flow path 20*a* described later. The steam supplied from the rotor steam flow path 20*a* is supplied to the second flow paths 92 and third flow paths 93 through the first flow path 91. The first flow path 91 is formed in a circular shape in the airfoil cross section. The first flow path 91 is formed at a position close to a center position in the blade surface direction W from the leading edge 71 or the trailing edge 72 in the airfoil cross section.

The steam flowing through the first flow path 91 is ejected from negative-pressure surface opening holes 92*a* formed on the negative-pressure surface 82 through the second flow paths 92. Each of the second flow paths 92 extends from the first flow path 91 toward the negative-pressure surface opening hole 92*a* in the airfoil cross section. The second flow path 92 of the present embodiment is formed so as to have a sectional flow path area smaller than that of the first flow path 91. The second flow path 92 is formed for each negative-pressure surface opening hole 92*a*. The plurality of second flow paths 92 are formed so as to radially extend from one first flow path 91 in the airfoil cross section.

The negative-pressure surface opening holes 92*a* are formed closer to the trailing edge 72 than the center position of the negative-pressure surface 82 in the blade surface direction W in the airfoil cross section. The negative-pressure surface opening holes 92*a* are formed on the negative-pressure surface 82 on the radially inner side Dri from the center position of the blade body 70 in the radial direction Dr of the rotor shaft 21. That is, the negative-pressure surface opening holes 92*a* are formed closer to the platform 35 than the center position of the blade body 70 in the blade height direction Z. In the present embodiment, the plurality of (two in the present embodiment) negative-pressure surface opening holes 92*a* are formed at intervals in the blade surface direction W. In addition, the plurality of negative-pressure surface opening holes 92*a* are formed at intervals in the radial direction Dr. Specifically, as shown in FIG. 1, in the present embodiment, six negative-pressure surface opening holes 92*a* are formed in the turbine blade 32 of the final stage in the radial direction Dr, five negative-pressure surface opening holes 92*a* are formed in the turbine vane 42 of the final stage in the radial direction Dr, four negative-pressure surface opening holes 92*a* are formed in the turbine blade 32 of the sixth stage 56 in the radial direction Dr, and four negative-pressure surface opening holes 92*a* are formed in the turbine vane 42 of the sixth stage 56 in the radial direction Dr.

In this way, the negative-pressure surface opening holes 92*a* are formed such that the negative-pressure surface opening holes 92*a* of the blade of the steam turbine disposed on the upstream side Dau are disposed at positions closer to the rotor shaft 21. That is, compared to the turbine blade 32 of the seventh stage 57, the turbine vane 42 of the seventh stage 57 has the negative-pressure surface opening holes 92*a* formed closer to the rotor shaft 21. In addition, compared to the turbine vane 42 of the seventh stage 57, the turbine blade 32 or the turbine vane 42 of the sixth stage 56 has the negative-pressure surface opening holes 92*a* formed closer to the rotor shaft 21.

In addition, although it is not described, in the first embodiment, each of the turbine blade 32 and the turbine vane 42 of the sixth stage 56 and the turbine vane 42 of the seventh stage 57 has the blade body 70 similar to that of the turbine blade 32 of the seventh stage 57. That is, in the present embodiment, each of the turbine blade 32 and the turbine vane 42 of the sixth stage 56 and the turbine vane 42 of the seventh stage 57 has the blade bodies 70 having structures similar to each other except for the number of the negative-pressure surface opening holes 92*a* and the positive-pressure surface opening holes 93*a* of each of the turbine blade 32 and the turbine vane 42 of the sixth stage 56 is different from the number of those of the turbine blade 32 of the seventh stage 57.

The rotor steam flow path 20*a* through which the high-pressure steam flows is formed in the rotor shaft 21. The rotor steam flow path 20*a* extends from the seal space 17 to the first flow paths 91 of the turbine blades 32 of the sixth stage 56 and the seventh stage 57. A portion of the main steam S leaked from the steam main flow path 15 in the vicinity of the speed-adjusting stage 50*a* to the seal space 17 is supplied to the first flow path 91 of each turbine blade 32 through the rotor steam flow path 20*a*. That is, a portion of the main steam S which has a pressure higher than that of the main steam S flowing through the steam main flow paths 15 of the sixth stage 56 and the seventh stage 57 and flows through the steam main flow path 15 in the vicinity of the speed-adjusting stage 50*a* is supplied to the first flow path 91 through the rotor steam flow path 20*a* of the present embodiment as steam.

Casing steam flow paths 10*a* through which high-pressure steam flows are formed in the casing 10. The casing steam flow paths 10*a* penetrate the outer ring 43 from the outside and extend to the first flow paths 91 of the turbine vanes 42 of the sixth stage 56 and the seventh stage 57. The high-pressure steam extracted before being supplied to the nozzle chamber 11 is supplied to the first flow paths 91 of the turbine vanes 42 of the sixth stage 56 and the seventh stage 57 through the casing steam flow path 10*a*. That is, a portion of the main steam S which is extracted before being supplied to the nozzle chamber 11 and has a pressure higher than that of the main steam S flowing through the steam main flow paths 15 of the sixth stage 56 and the seventh stage 57 is supplied to the first flow path 91 of the turbine vane 42 through the casing steam flow path 10*a* of the present embodiment as steam.

As described above, according to the turbine blade 32 or the turbine vane 42 of the first embodiment, a portion of the main steam S on the upstream side Dau is supplied to the first flow path 91 via the rotor steam flow path 20*a* or the casing steam flow path 10*a*. Accordingly, the steam having the pressure higher than that of the main steam S flowing through the surrounding steam main flow path 15 can be supplied to the negative-pressure surface opening holes 92*a*. Accordingly, the steam can be ejected from the negative-pressure surface opening holes 92*a* to the trailing edge 72 side of the negative-pressure surface 82. Therefore, the steam ejected from the negative-pressure surface opening holes 92*a* can be joined to the flow of the main steam S flowing to the trailing edge 72 side along the negative-pressure surface 82. As a result, the development of a boundary layer around the trailing edge 72 side of the negative-pressure surface 82 can be suppressed by the ejected steam. Accordingly, separation on the negative-pressure surface 82 can be effectively suppressed.

In addition, the negative-pressure surface opening holes 92*a* are formed closer to the trailing edge 72 than the center position in the blade surface direction W, and thus, it is possible to intensively supply the steam to the negative-pressure surface 82 on the trailing edge 72 side. Accordingly, it is possible to suppress the separation effectively using the steam on the trailing edge 72 side of the negative-pressure surface 82 at which the separation is easily generated.

In addition, the negative-pressure surface opening holes 92*a* are formed closer to the platform 35 than the center position in the blade height direction Z, and it is possible to intensively supply the steam to the vicinity of the platform 35 which is positioned on the radially inner side Dri in the negative-pressure surface 82. Accordingly, it is possible to effectively suppress the separation using the steam in the vicinity of the platform 35 of the negative-pressure surface 82 at which the separation is easily generated.

In addition, the negative-pressure surface opening holes 92*a* are formed in the turbine blade 32 and the turbine vane 42 of the final stage. Therefore, the main steam S flowing backward from the exhaust chamber 13 side where an outlet of the steam main flow path 15 is formed toward the steam main flow path chamber 12 side can be pushed back to the exhaust chamber 13 side from the final stage.

Figure 3:
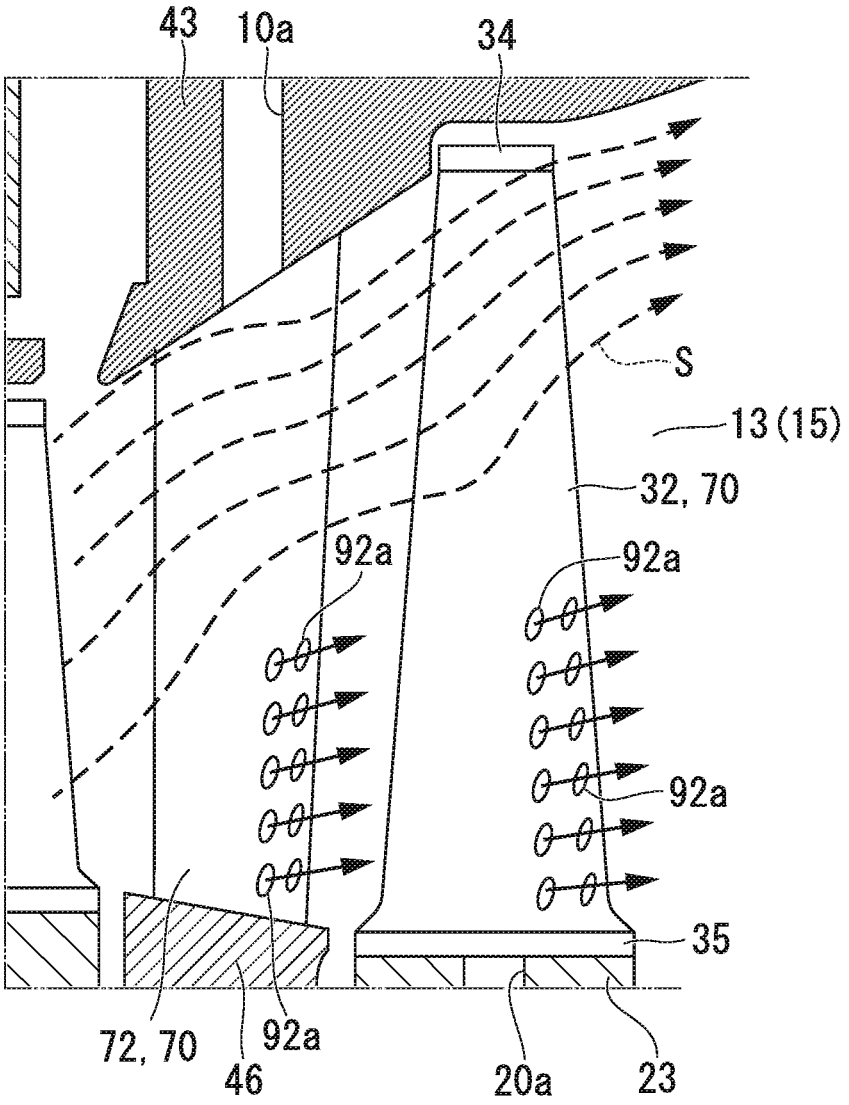
FIG. 3 is an enlarged sectional view of a final stage of the steam turbine in the first embodiment of the present invention.

In the steam turbine 1, the flow rate of main steam S flowing through the steam main flow path 15 decreases when a low load operation or a low vacuum operation is performed. As a result, the main steam S is likely to flow backward in the vicinity of the final stage close to the outlet. Particularly, as shown in FIG. 3, the main steam S is collected on a tip side of the blade body 70 by a centrifugal force generated by the rotation of the turbine blade 32. As a result, in the steam main flow path 15 in which the final stage is provided, the flow rate of the main steam S in the region on the radially inner side Dri of the blade body 70 which is the region closer to the rotor shaft 21 side easily decreases.

Meanwhile, in the present embodiment, the steam is ejected from the negative-pressure surface opening holes 92*a* of the turbine blade 32 or the turbine vane 42 of the final stage, and thus, it is possible to increase the flow rate of the main steam S which flows through the steam main flow path 15 on the radially inner side Dri of the final stage. Accordingly, it is possible to prevent the main steam S in the vicinity of the final stage from flowing backward.

In addition, in the above-described steam turbine 1, the turbine blade 32 or the turbine vane 42 having the negative-pressure surface opening holes 92*a* is provided, and thus, it is possible to suppress the separation of the main steam S in the steam main flow path 15, and it is possible to improve blade efficiency. In addition, the negative-pressure surface opening holes 92*a* are provided on the turbine blade 32 and the turbine vane 42 of the final stage, and thus, it is possible to suppress the occurrence of a backflow of the main steam S, and it is possible to decrease a loss generated by the backflow. Accordingly, it is possible to improve operation efficiency of the steam turbine.

Second Embodiment

Next, a second embodiment of the steam turbine of the present invention will be described. In the steam turbine shown in the second embodiment, some turbine blades and turbine vanes are different from those of the steam turbine 1 of the first embodiment. Accordingly, in descriptions of the second embodiment, the same reference numerals are assigned to the same portions as those of the first embodiment, and overlapping descriptions are omitted. That is, descriptions of the entire configuration of the steam turbine common to the configurations described in the first embodiment are omitted.

Figure 4:
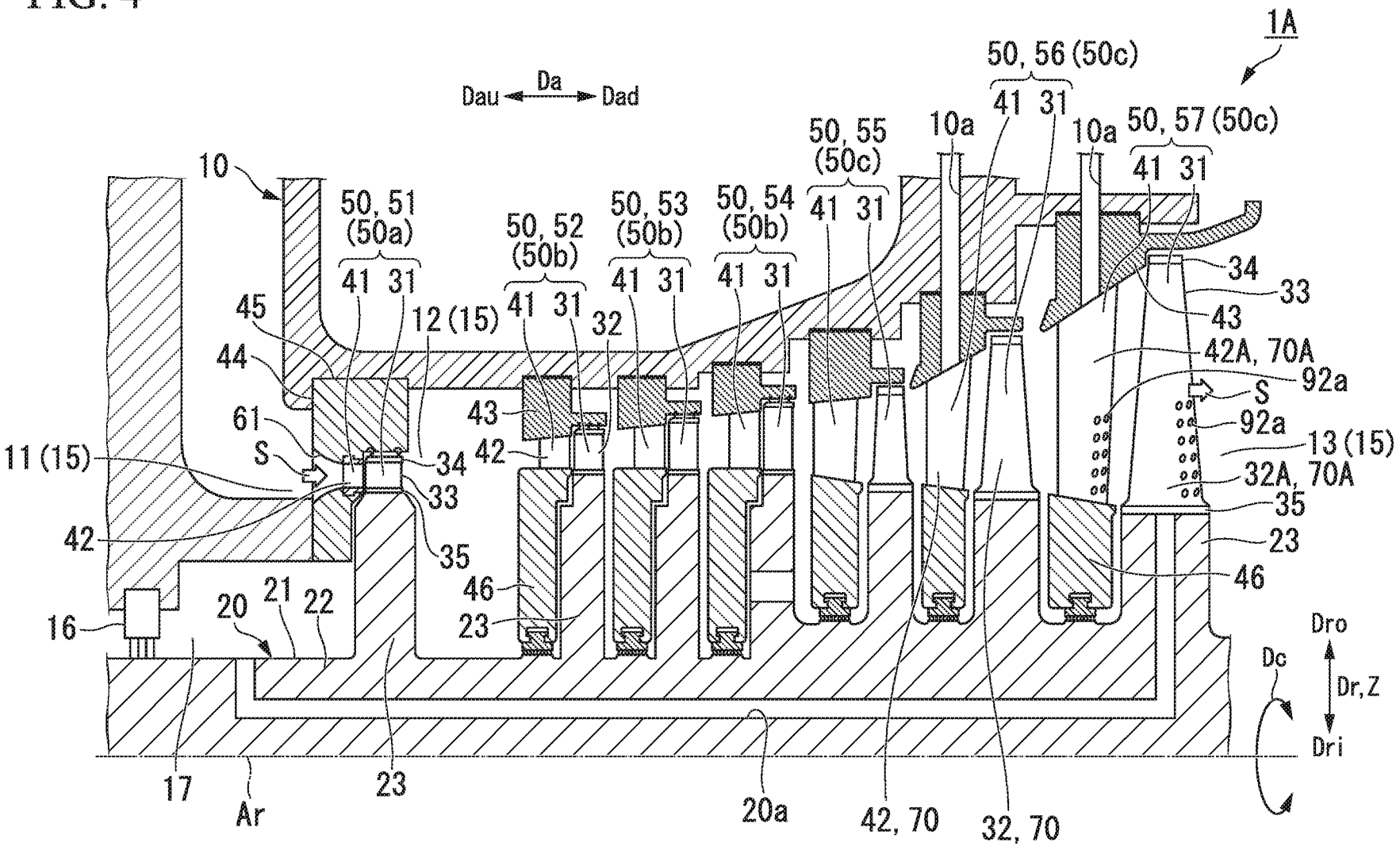
FIG. 4 is a sectional view of a steam turbine in a second embodiment of the present invention.

In a steam turbine TA of the second embodiment, as shown in FIG. 4, in the blade of the steam turbine, only a turbine blade 32A and a turbine vane 42A of the seventh stage 57 are different from those of the first embodiment. Here, in the second embodiment, as examples of the blade of the steam turbine, the turbine blade 32A of the seventh stage 57 of the turbine blade 32A and the turbine vane 42A of the seventh stage 57 are described.

In a blade body 70A of the turbine blade 32A of the second embodiment, the first flow path 91, the second flow paths 92, and third flow paths 93 are formed inside the blade body 70A. The shapes of the first flow path 91 and the second flow paths 92 of the second embodiment are similar to those of the first embodiment.

Figure 5:
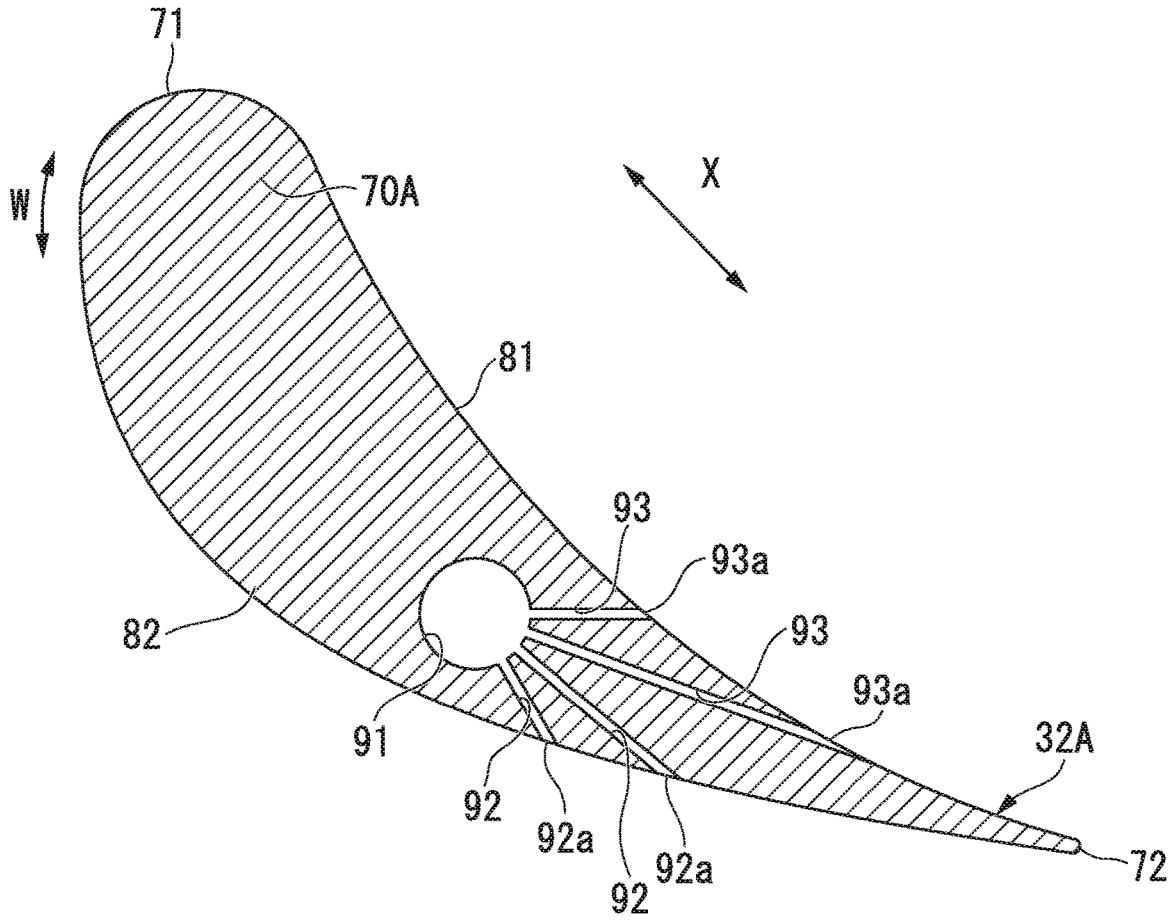
FIG. 5 is a sectional view of a turbine blade in the second embodiment of the present invention.

As shown in FIG. 5, the steam flowing through the first flow path 91 is ejected from the positive-pressure surface opening holes 93*a* formed on the positive-pressure surface 81 through the third flow paths 93. Each of the third flow paths 93 extends from the first flow path 91 toward the positive-pressure surface opening hole 93*a* in the airfoil cross section. The third flow path 93 of the present embodiment extends in a direction different from the second flow path 92 with a camber line as a boundary. The third flow path 93 is formed so as to have the sectional flow path area smaller than that of the first flow path 91. The third flow path 93 of the present embodiment is formed to have the second flow path area similar to that of the second flow path 92. The third flow path 93 is formed for each positive-pressure surface opening hole 93*a*. The plurality of third flow paths 93 are formed to radially extend from one first flow path 91 together with the second flow paths 92.

The positive-pressure surface opening holes 93*a* are formed closer to the trailing edge 72 than the center position of the positive-pressure surface 81 in the blade surface direction W in the airfoil cross section. The positive-pressure surface opening holes 93*a* are formed on the positive-pressure surface 81 on the radially inner side Dri from the center position of the blade body 70A in the radial direction Dr. That is, the positive-pressure surface opening holes 93*a* are formed closer to the platform 35 than the center position of the blade body 70A in the blade height direction Z. In the present embodiment, the plurality of (for example, two in the present embodiment) positive-pressure surface opening holes 93*a* are formed at intervals in the blade surface direction W. In addition, the plurality of positive-pressure surface opening holes 93*a* are formed at intervals in the radial direction Dr. Specifically, in the present embodiment, six positive-pressure surface opening holes 93*a* are formed at equal intervals in the turbine blade 32A of the final stage in the radial direction Dr, and five positive-pressure surface opening holes 93*a* are formed at equal intervals in the turbine vane 42A of the final stage in the radial direction Dr.

In this way, the positive-pressure surface opening holes 93*a* are formed such that the positive-pressure surface opening holes 93*a* of the blade of the steam turbine disposed on the upstream side Dau are disposed at positions closer to the rotor shaft 21. That is, compared to the turbine blade 32A of the seventh stage 57, the turbine vane 42A of the seventh stage 57 has the positive-pressure surface opening holes 93*a* formed closer to the rotor shaft 21.

In addition, although it is not described, in the second embodiment, the turbine vane 42A of the seventh stage 57 has the blade body 70A similar to that of the turbine blade 32A of the seventh stage 57.

According to the turbine blade 32A or the turbine vane 42A of the above-described second embodiment, the steam can be ejected from the positive-pressure surface opening holes 93*a* to the trailing edge 72 side of the positive-pressure surface 81. Therefore, the steam ejected from the positive-pressure surface opening holes 93*a* can be joined to the flow of the main steam S flowing to the trailing edge 72 side along the negative-pressure surfaces 82 of the other turbine blades 32A or the turbine vanes 42A adjacent in the circumferential direction Dc. That is, the steam can be supplied not only from the negative-pressure surface opening holes 92*a* but also from the positive-pressure surface opening holes 93*a* to the region where the separation is likely to occur. As a result, it is possible to suppress the development of a boundary layer in the vicinity of the trailing edge 72 side on the negative-pressure surfaces 82 of the other turbine blades 32A or the turbine vanes 42A adjacent in the circumferential direction Dc by a lot of steam, with high accuracy. Accordingly, the separation on the negative-pressure surface 82 can be effectively suppressed.

In addition, the positive-pressure surface opening holes 93*a* are formed on the trailing edge 72 side from the center position in the blade surface direction W. Accordingly, the steam can be intensively supplied not only from the negative-pressure surface opening holes 92*a* but also from the positive-pressure surface opening holes 93*a* to the negative-pressure surface 82 of the adjacent turbine blade 32A or the adjacent turbine vane 42A on the trailing edge 72 side. Accordingly, it is possible to suppress the separation with high accuracy effectively using the steam on the trailing edge 72 side of the negative-pressure surface 82 at which the separation is easily generated.

In addition, the negative-pressure surface opening holes 92*a* are formed on the platform 35 side from the center position in the blade height direction Z. Accordingly, it is possible to intensively supply the steam not only from the negative-pressure surface opening holes 92*a* but also from the positive-pressure surface opening holes 93*a* to the vicinity of the platform 35 which is positioned on the radially inner side Dri in the negative-pressure surface 82 of the adjacent turbine blade 32A or the adjacent turbine vane 42A. Therefore, it is possible to suppress the separation with high accuracy effectively using the steam in the vicinity of the platform 35 of the negative-pressure surface 82 at which the separation is easily generated.

In addition, not only the negative-pressure surface opening holes 92*a* but also the positive-pressure surface opening holes 93*a* are formed in the turbine blade 32A and the turbine vane 42A of the final stage. Accordingly, the main steam S flowing backward from the exhaust chamber 13 side where the outlet of the steam main flow path 15 is formed can be pushed back to the exhaust chamber 13 side by a lot of steam. That is, the steam is ejected from the negative-pressure surface opening holes 92*a* and the positive-pressure surface opening holes 93*a* of the turbine blade 32A or the turbine vane 42A of the final stage, and thus, it is possible to largely increase the flow rate of the main steam S flowing through the steam main flow path 15 at the final stage. Accordingly, it is possible to suppress the occurrence of the backflow of the main steam S in the vicinity of the final stage, with high accuracy.

In addition, in the above-described steam turbine 1A, the turbine blade 32A or the turbine vane 42A having the negative-pressure surface opening holes 92*a* and the positive-pressure surface opening holes 93*a* is provided, and thus, it is possible to further suppress the separation of the main steam S in the steam main flow path 15, and it is possible to largely improve blade efficiency. In addition, the negative-pressure surface opening holes 92*a* are provided on the turbine blade 32A and the turbine vane 42A of the final stage, and thus, it is possible to suppress the occurrence of the backflow of the main steam S with high accuracy, and it is possible to largely decrease a loss generated by the backflow. Accordingly, it is possible to largely improve operation efficiency.

Hereinbefore, the embodiments of the present invention are described in detail with reference to the drawings. However, the respective configurations and combinations thereof in the respective embodiments are merely examples, and additions, omissions, substitutions, and other modifications of configurations are possible within the scope which does not depart from the gist of the present invention. In addition, the present invention is not limited to the embodiments and is limited by only claims.

In addition, in the first embodiment, only the sixth stage 56 and the seventh stage 57 have the first flow paths 91 and the second flow paths 92, and in the second embodiment, only the seventh stage 57 has the first flow paths 91, the second flow paths 92, and the third flow paths 93. However, the configuration of the blade of the steam turbine is not limited to the above-described embodiments. For example, in order to suppress the separation, the turbine blades 32 and the turbine vanes 42 of all the stages 50 may have the blade bodies 70 and 70A of the present embodiments, and only the turbine blade 32 and the turbine vane 42 on the upstream side Dau may have the blade bodies 70 and 70A. In addition, in order to suppress the backflow of the main steam S at the final stage, only the turbine blade 32A at the final stage may have the blade bodies 70 and 70A of the present embodiment.

Moreover, the steam supplied to the first flow path 91 may be any steam as long as a pressure of the steam is higher than that of the main steam S flow through the periphery of the blade of the steam turbine in which the first flow path 91 is formed. Accordingly, the steam is not limited to the steam supplied from the rotor steam flow path 20*a* or the casing steam flow path 10*a* of the present embodiment. That is, the steam flowing through the first flow path 91 may be the steam obtained by extracting a portion of the main steam S flowing through the steam main flow path 15 on the upstream side Dau. Accordingly, the steam supplied to the first flow path 91 may use a portion leaked from the main steam S flowing through the periphery of the turbine blade 32 or the turbine vane 42 one stage before.

INDUSTRIAL APPLICABILITY

According to the above-described blade of the steam turbine, it is possible to effectively suppress the separation on the negative-pressure surface 82 by ejecting the steam from the negative-pressure surface opening hole 92*a*.

REFERENCE SIGNS LIST

1, 1A: steam turbine
Da: axial direction
Dau: upstream side
Dad: downstream side
Dr: radial direction
Dri: radially inner side
Dro: radially outer side
Dc: circumferential direction
20: rotor
Ar: axis
21: rotor shaft
22: axial core portion
23: disk portion

20*a*: rotor steam flow path
31: turbine blade row
32, 32A: turbine blade
70, 70A: blade body
71: leading edge
72: trailing edge
W: blade surface direction
Z: blade height direction
X: blade chord direction
81: positive-pressure surface
82: negative-pressure surface
91: first flow path
92: second flow path
92*a*: negative-pressure surface opening hole
34: shroud
35: platform
41: turbine vane row
42, 42A: turbine vane
43: outer ring
46: inner ring
S: main steam
10: casing
11: nozzle chamber
12: steam main flow path chamber
13: exhaust chamber
15: steam main flow path
17: space
10*a*: casing steam flow path
50: stage
51: first stage
52: second stage
53: third stage
54: fourth stage
55: fifth stage
56: sixth stage
57: seventh stage
50*a*: speed-adjusting stage
50*b*: intermediate pressure stage
50*c*: low-pressure stage
93: third flow path
93A: positive-pressure surface-side opening hole

What is claimed is:

1. A steam turbine, comprising:

a rotor shaft that rotates about an axis;

a casing that rotatably covers the rotor shaft;

turbine blades of turbine blade rows that are fixed to a radially outer side of the rotor shaft and are arranged in an axial direction in which the axis extends; and turbine vanes of turbine vane rows that are each disposed adjacent to an upstream side of each of the turbine blade rows in the axial direction and that configure stages together with the turbine blade rows, wherein each of the stages comprises one of the turbine vane rows and one of the turbine blade rows that is adjacent to a downstream side of the one of the turbine vane rows in the axial direction, wherein each of turbine blades of the turbine blade rows and turbine vanes of the turbine vane rows in a final stage disposed on a most downstream side among the stages and in a stage disposed on an upstream side of the final stage in the axial direction comprises:

a blade body that is disposed in a steam main flow path formed around a rotary shaft such that main steam flows through the steam main flow path, the blade body having an airfoil cross section in which a concave positive-pressure surface and a convex negative-pressure surface are continuous to each other via a leading edge and a trailing edge, wherein the blade body comprises:

a first flow path that is formed inside the blade body to extend in a blade height direction intersecting the airfoil cross section and through which steam having a pressure higher than that of the main steam to which the positive-pressure surface and the negative-pressure surface are exposed flows; and a second flow path through which the steam flowing through the first flow path is ejected from a negative-pressure surface opening hole formed on the negative-pressure surface, wherein the negative-pressure surface opening hole is formed on a radially inner side from a center position of the blade body in a radial direction of the rotor shaft, wherein the negative-pressure surface opening hole is formed such that the negative-pressure surface opening hole of the blade body disposed on the upstream side is disposed at positions on an inner radial side of the blade body, wherein the casing comprises:

a seal space connected to the steam main flow path; and a casing steam flow path that connects the first flow path of the blade body disposed in each of the turbine vane rows to an outside of the steam turbine, wherein the seal space is formed by a gap between one of the turbine vane rows and one of the turbine blade rows at a speed-adjusting stage that is a most upstream stage among the stages, and wherein the rotor shaft comprises a rotor steam flow path that connects the first flow path of the blade body disposed in each of the turbine blade rows to the seal space.

2. The steam turbine according to claim 1, wherein the negative-pressure surface opening hole is formed on a side closer to the trailing edge than a center position in a blade surface direction that has a component in a blade chord direction of the blade body and that is a direction along the negative-pressure surface in the airfoil cross section.

3. The steam turbine according to claim 1, further comprising:

a third flow path that extends from the first flow path toward the trailing edge side and through which the steam flowing through the first flow path is ejected from a positive-pressure surface opening hole formed on the positive-pressure surface.

4. The steam turbine according to claim 3, wherein the positive-pressure surface opening hole is formed on a side closer to the trailing edge than a center position in a blade surface direction that has a component in a blade chord direction of the blade body and that is a direction along the positive-pressure surface in the airfoil cross section.

5. The steam turbine according to claim 3, wherein the positive-pressure surface opening hole is formed on a radially inner side from a center position of the blade body in a radial direction of the rotor shaft.

* * * * *